United States Patent [19]

Mailliet et al.

[11] Patent Number: 4,755,095

[45] Date of Patent: Jul. 5, 1988

[54] DEVICE FOR CLOSING A TOP CENTRAL OPENING OF A VESSEL AND ITS APPLICATION TO A STORAGE HOPPER IN A SHAFT FURNACE CHARGING INSTALLATION

[75] Inventors: Pierre Mailliet, Howald; Germain Schilz, Esch, both of Luxembourg

[73] Assignee: Paul Wurth S.A., Luxembourg, Luxembourg

[21] Appl. No.: 68,106

[22] Filed: Jun. 29, 1987

[30] Foreign Application Priority Data

Jun. 30, 1986 [LU] Luxembourg ..... 86495

[51] Int. Cl.[4] ..... F23K 3/06

[52] U.S. Cl. ..... 414/200; 222/505; 251/215; 251/228; 414/221

[58] Field of Search ..... 414/199–203, 414/169, 221; 222/502, 503, 505, 506, 508, 544, 545; 251/212, 215, 228, 298, 301

[56] References Cited

U.S. PATENT DOCUMENTS 2,088,977 8/1937 Scholler et al. ..... 222/505 X
2,771,266 11/1956 Larsson ..... 222/508 X
2,999,666 9/1961 Sjogren ..... 251/228 X
3,843,090 10/1974 Schneider et al. ..... 251/215
4,074,835 2/1978 Legille et al. ..... 414/200 X
4,514,129 4/1985 Legille et al. ..... 414/200

FOREIGN PATENT DOCUMENTS 1334739 7/1963 France ..... 251/301

*Primary Examiner*—Joseph E. Valenza
*Assistant Examiner*—David A. Bucci
*Attorney, Agent, or Firm*—Fishman, Dionne & Cantor

[57] ABSTRACT

This invention relates to a device comprising a sealing valve carried by a control arm inside a vessel and cooperating with a seat around an opening. The mechanism for operating the valve comprises a hollow rotary support housed about its axis of rotation X in a leaktight bearing on the wall of the vessel and connected to the other end of the control arm by means of a device permitting axial displacement of the valve in relation to its seat. In order to reduce the space required for the movements of the valve, the support of the valve operating mechanism is mounted in such a manner that its axis of rotation X forms an acute angle with the vertical axis of the opening of the vessel.

4 Claims, 8 Drawing Sheets

Fig. 6
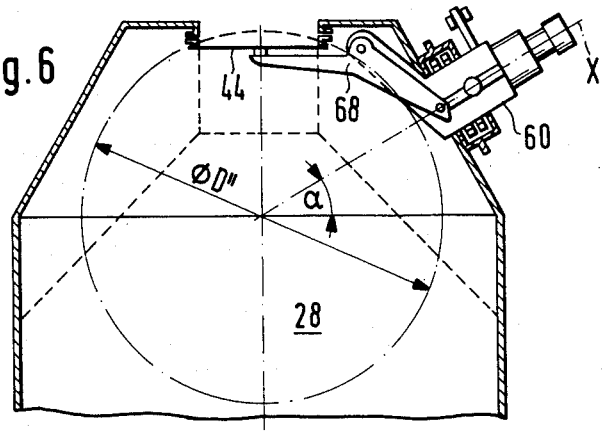
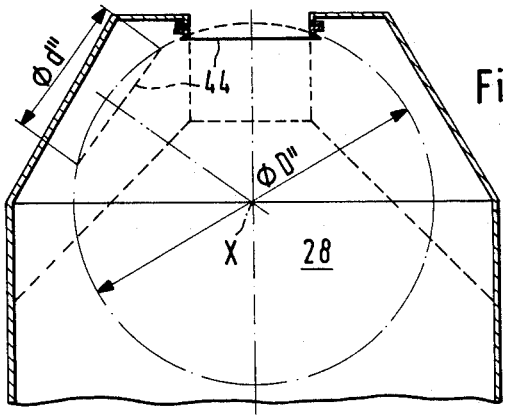
Fig. 7
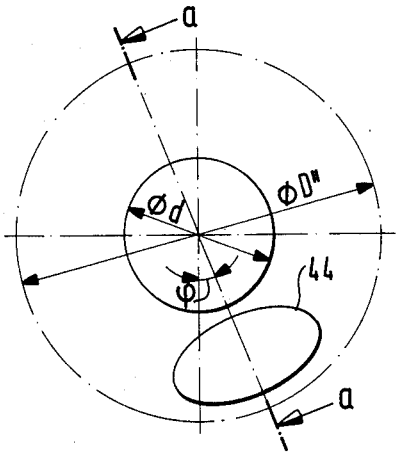
Fig. 7a

Fig.10
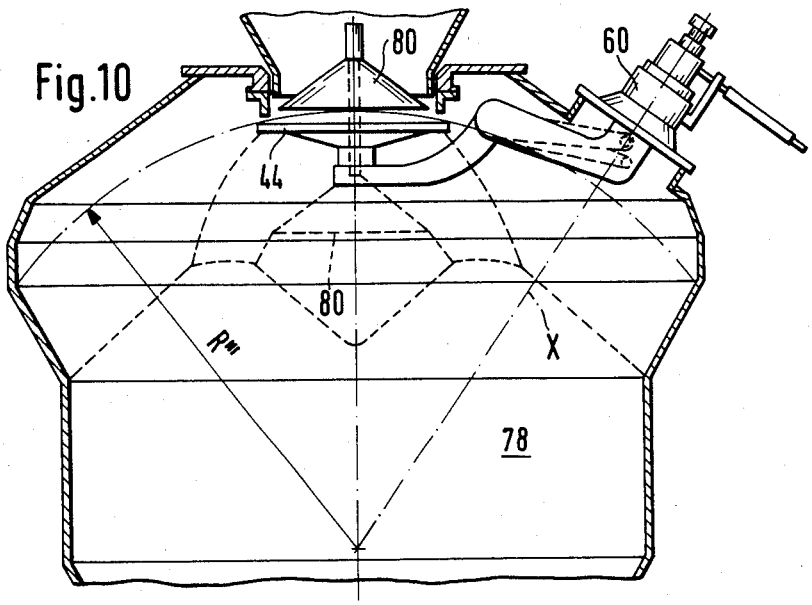
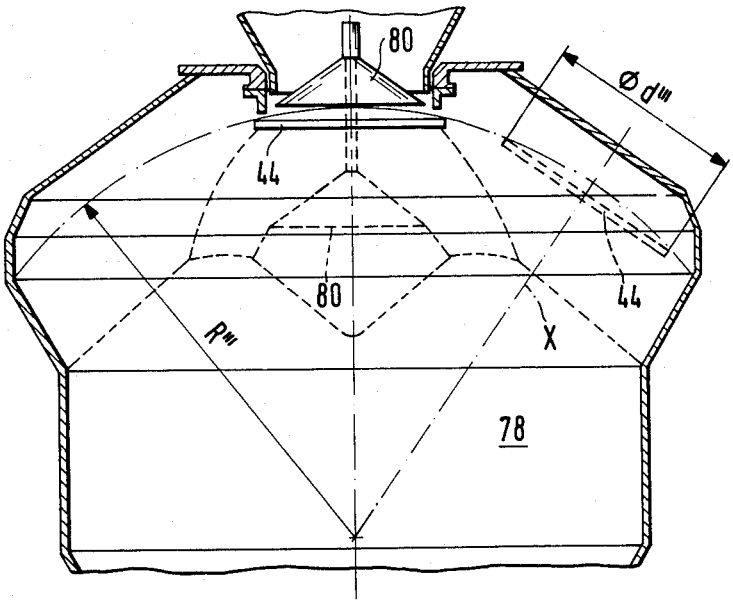
Fig.11

DEVICE FOR CLOSING A TOP CENTRAL OPENING OF A VESSEL AND ITS APPLICATION TO A STORAGE HOPPER IN A SHAFT FURNACE CHARGING INSTALLATION

BACKGROUND OF THE INVENTION

This invention relates to a device for closing a top central opening in a vessel. More particularly, this invention relates to a vessel closure apparatus comprising a sealing valve in the form of a spherical dome carried by one end of a control arm inside the vessel and cooperating with a seat around the vessel opening; and a valve operating mechanism comprising a hollow rotary support housed about its axis of rotation in a leaktight bearing on the wall of the vessel and connected to the other end of the control arm by means of a device permitting axial displacement of the valve in relation to its seat. This invention also relates to the application of a closure device of this type to a storage hopper in a shaft furnace charging installation.

A shaft furnace charging installation provided with a closure device of the type described above is described in European Patent No. EP0062770 corresponding to U.S. Pat. No. 4,514,129, assigned to the assignee hereof, all of the contents of which are incorporated herein by reference. The storage hopper in this patent is provided with top and bottom sealing valves of the type described above and shown in detail in FIG. 4 of that patent.

In that prior patent, the bottom sealing valve moves in a valve cage outside the vessel, while the top sealing valve is always disposed inside the vessel. The top sealing valve includes the disadvantage of reducing the capacity of the vessel, because when it is opened, it is turned about an axis at right angles to the axis of the hopper in order to assume a substantially vertical position. The filling of the hopper must therefore be interrupted before the poured cone of charging material touches the valve in its open position. In other words, the capacity of the hopper is reduced by a certain volume, which can be characterized as "wasted space". This means that a larger hopper must be provided in order to introduce a predetermined quantity of material into the furnace for each cycle.

SUMMARY OF THE INVENTION

The above discussed and other problems and deficiencies of the prior art are overcome or alleviated by the vessel closure apparatus of the present invention. In accordance with the present invention, an improved closure device is provided which permits a substantial reduction of wasted space in the top part of the vessel which results from the opening of the sealing valve.

In a preferred embodiment of the present invention, the closure device is of the type described in U.S. Pat. No. 4,514,129. However, in contrast to that prior closure device, the present invention includes a support of the valve operating mechanism mounted in such a manner that its axis of rotation forms an acute angle with the vertical axis of the vessel opening.

The above discussed and other advantages of the present invention will be apparent to and understood by those skilled in the art from the following detailed description and drawings.

DESCRIPTION OF THE DRAWINGS

Referring now to the drawings, wherein like elements are numbered alike in the several Figures:

FIG. 6 is a cross sectional elevation view, showing a device for closing a top hopper opening in accordance with the present invention;

FIG. 7 is a cross sectional elevation view showing the valve of FIG. 6 in the open position;

FIG. 7A is a diagrammatic horizontal view showing the open position of the valve;

FIG. 10 is an elevation view, partly in cross section, corresponding to FIG. 9 showing the charging of the hopper;

FIG. 11 is an elevation view, partly in cross section, corresponding to FIG. 9 showing the charging of the hopper.

DESCRIPTION OF THE PREFERRED EMBODIMENT

Figure 1:
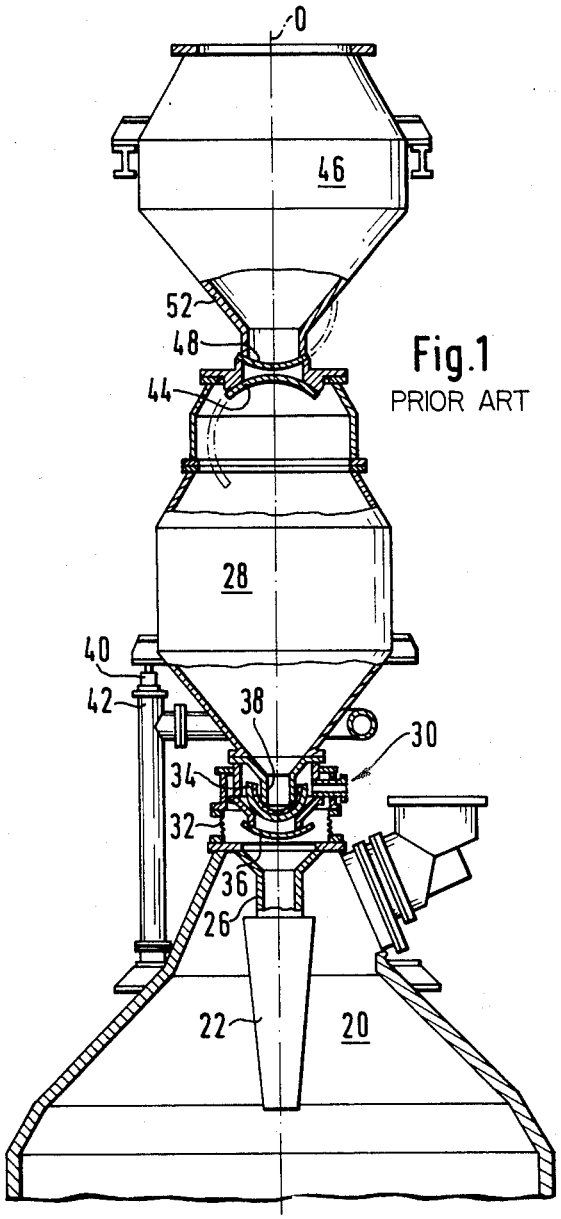
Fig.1 PRIOR ART
FIG. 1 is a diagrammatic view, partly in cross section, of a shaft furnace charging installation in accordance with the prior art.

Referring first to FIG. 1, a known charging installation of the type described in the previously mentioned U.S. Pat. No. 4,514,129 is shown. FIG. 1 includes the top portion of a shaft furnace 20, in which a spout 22 is suspended in order to effect the distribution of charging material poured into the furnace. Spout 22 is operated by an appropriate mechanism housed in a chamber formed around a central duct 26. Duct 26 guides the material which is to be charged into the furnace towards spout 22.

In the illustrated embodiment, a storage vessel 28, designed in the form of a lock chamber and provided for that purpose with a bottom sealing valve 36 and a top sealing valve 44, is mounted above furnace 20. Between lock chamber 28 and the furnace is positioned a valve cage 30 containing, in addition to the bottom sealing valve 36, metering device 34 adapted for controlling the flow of charge material through an outlet pipe 38 forming the bottom lock chamber 28.

Lock chamber 28 in the FIG. 1 embodiment is subjected to continuous or periodic weighing for the purpose of determining its content. It is for this reason that valve cage 30 is provided with peripheral compensator 32 for the purpose of disconnecting lock chamber 28 from furnace 20. The actual weighing is effected with the aid of a plurality of weighing means 40, of which there are preferably three and on which the lock chamber rests. Weighing means 40 are carried by fixed uprights 42 forming part of the framework or superstructure of the furnace.

Above lock chamber 28 is disposed a holding hopper 46, which is filled while lock chamber 28 is being emptied. A nonreturn valve 48 provided in the bottom of an outlet connection 52 of hopper 46 enables communication to be established between hopper 46 and the chamber 28 when sealing valve 44 is open. In order to achieve the fastest possible transfer of charge material from holding hopper 46 to lock chamber 28, the passage section between holding hopper 46 and lock chamber 28 is preferably as large as possible. As a result, the size of valve 44 must be configured in accordance with the size of this section.

Figure 2:
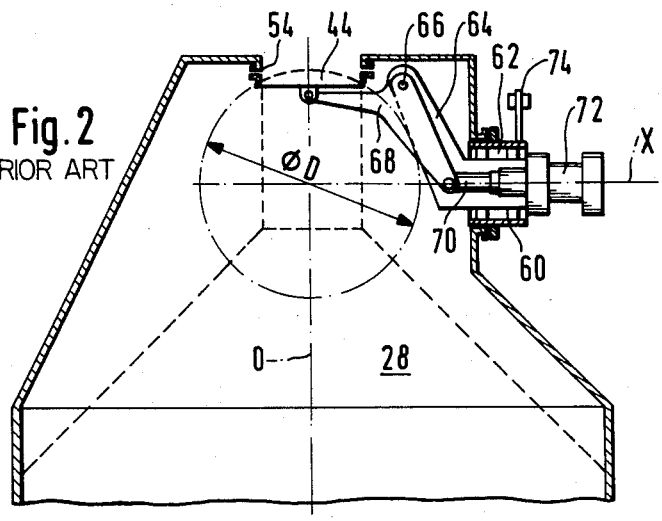
Fig. 2 PRIOR ART
FIG. 2 is a diagrammatic view, partly in cross section, showing details for closing the top opening of the charging hopper in accordance with the prior art.

Top sealing valve 44 is in the form of a spherical dome, and for the purpose of ensuring a leaktight seal of lock chamber 28, it cooperates with annular seat 54 turned towards the interior of lock chamber 28. FIG. 2 shows details of a form of construction of a mechanism for operating valve 44. This mechanism corresponds to that shown in FIG. 14 of the previously mentioned U.S. Pat. No. 4,514,129. This mechanism comprises a hollow rotary support 60 housed about its axis of rotation X in a leaktight bearing 62 in a wall 58 of vessel 28. Support 60 is extended in the inward direction of vessel 28 by a clevis 64 provided at its end with a pivot 66 forming a support and pivot pin for a bent arm 68. One end of bent arm 68 carries valve 44, while its opposite end is pivoted on rod 70 undergoing a longitudinal axial movement in the support 60 through the action of motor 72. Motor 72 may be, for example, electric, hydraulic or pneumatic motor. Support 60 is provided with an arm 74 connected directly to a hydraulic jack or to a worm (not shown), in order to pivot support 60 about the axis X.

The complete opening of valve 44 first comprises disengaging it from its seat 54 by operating motor 72, which moves rod 70 to the right in FIG. 2. This movement enables valve 44 to pivot (by the action of the motor and of its own weight), about pivot 66 in a counter clockwise direction. The disengagement of valve 44 from the opening, that is, the opening of the passage into vessel 28, consists of turning the assembly comprised of valve 44, bent arm 68 and support 60 about the axis X by acting on arm 74 by means of the jack (not shown), so as to bring valve 44 into a parked or open position, as illustrated diagrammatically in FIG. 3 (which shows a view turned 90° in relation to the view shown in FIG. 2). The closing of valve 44 entails the same operations in the opposite direction, that is, the rotation of support 60 about the axis X followed by a translatory movement, to the left in FIG. 2, of rod 70 by motor 72 in order to apply valve 44 against its seat 54.

Taking into account the position of valve 44 when it is open (see FIGS. 3 and 3A), the maximum filling level of lock chamber 28 is represented by broken line 76 representing the poured cone. This means that the space between level 76 and top wall 58 of lock chamber 28 is "wasted" in terms of the capacity of the chamber.

Figure 3:
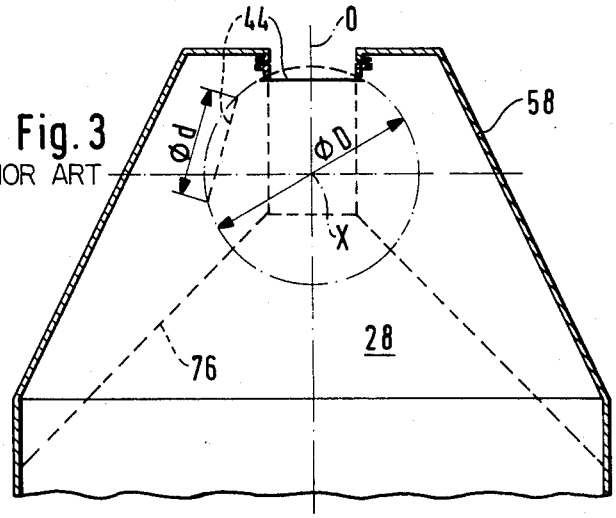
Fig. 3 PRIOR ART
FIG. 3 is a diagrammatic side view, partly in cross section, similar to FIG. 2 but illustrating the valve of FIG. 2 in the open position.
Figure 3A:
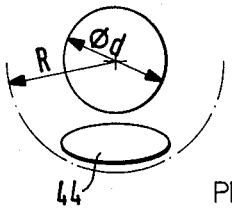
Fig. 3a PRIOR ART
FIG. 3A is a diagrammatic horizontal view showing the open and closed positions of the valve of FIG. 2.
Figure 4:
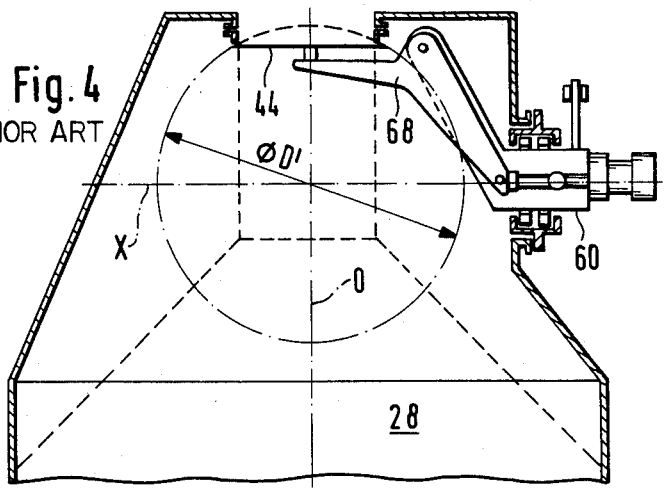
Fig. 4 PRIOR ART
FIG. 4 is a diagrammatic view, partly in cross section, corresponding to FIG. 2, showing a storage hopper having a wider top opening.
Figure 5:
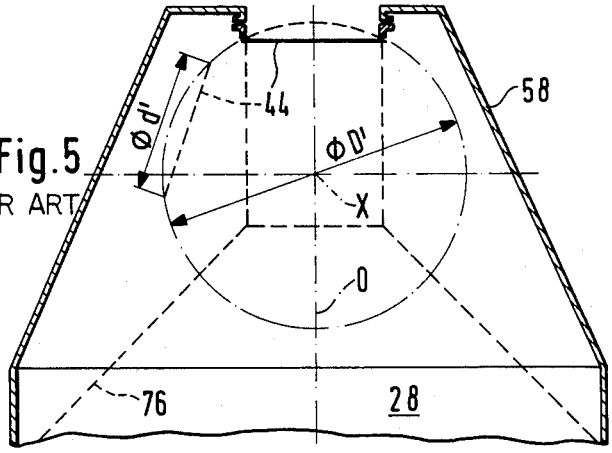
Fig. 5 PRIOR ART
FIG. 5 is a diagrammatic view, partly in cross section, corresponding to FIG. 3, showing a storage hopper having a wider top opening.
Figure 5A:
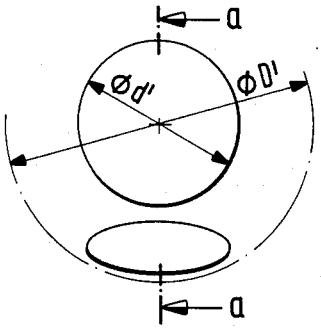
Fig. 5a PRIOR ART
FIG. 5A is a diagrammatic view corresponding to FIG. 3A, showing a storage hopper having a wider top opening.

This "wasted space" is dependent on the diameter of the opening and of valve 44. On the opening of valve 44, the valve actually turns in a circle whose radius corresponds to the distance between the point of intersection of the axis of rotation X of the valve and the vertical axis 0 of lock chamber 28, and the level of the opening. If the diameter of the opening and of valve 44 increases, the radius of the circle described by the valve also increases, as shown in FIGS. 4, 5 and 5A. Comparison of these last-mentioned figures with FIGS. 2 and 3 shows in particular that an increase of the section of valve 44 from d to d′ changes the diameter of the sphere of displacement of valve 44 from D to D′ and substantially increases the wasted space above pouring cone 76. In other words, in order to reduce this wasted space it would thus be necessary to reduce the cross section of valve 44. However, such a reduction conflicts with the previously mentioned requirement of providing the largest possible filling opening for the purpose of reducing the filling time of lock chamber 28.

In order to solve this problem, the present invention provides another arrangement of the support 60 of valve 44. This novel configuration permits less deep penetration of valve 44 into lock chamber 28 when it is opened. In other words, an arrangement of support 60 in accordance with the present invention as shown in FIG. 6 will permit, for the same section of the opening of lock chamber 28, better filling of the latter, or, for the same filling of lock chamber 28, an increase of the section of its opening.

This is made possible by disposing support 60, as shown in FIG. 6, in such a manner that its axis of rotation X forms an acute angle with a horizontal plane, instead of being horizontal as in the construction shown in FIGS. 2 and 4.

The effect of this oblique arrangement of the axis of rotation of valve 44 is dual. Comparison of FIG. 6 with FIG. 4 shows that for a valve having the same the diameter D of the sphere of displacement of valve 44 has increased substantially in FIG. 6. This is due to the fact that because of the inclination of the axis X, the point of intersection of the latter with the axis 0 has been lowered, which thus increases the distance from valve 44, that is, the radius of the sphere of displacement of the valve.

Comparison of FIGS. 5A and 7A, which show in horizontal projection the position of valve 44 when it is open, reveals that in the embodiment shown in FIG. 4, the center of valve 44 is displaced in a diametrical vertical plane at right angles to the plane of FIG. 4, whereas in the embodiment shown in FIG. 6, the plane of displacement of the center of the valve is offset by an angle $\phi$ (see FIG. 7A) in a relation to that shown in FIG. 5A; the angle $\phi$ being proportional to the inclination of the axis X in relation to the horizontal.

Figure 8:
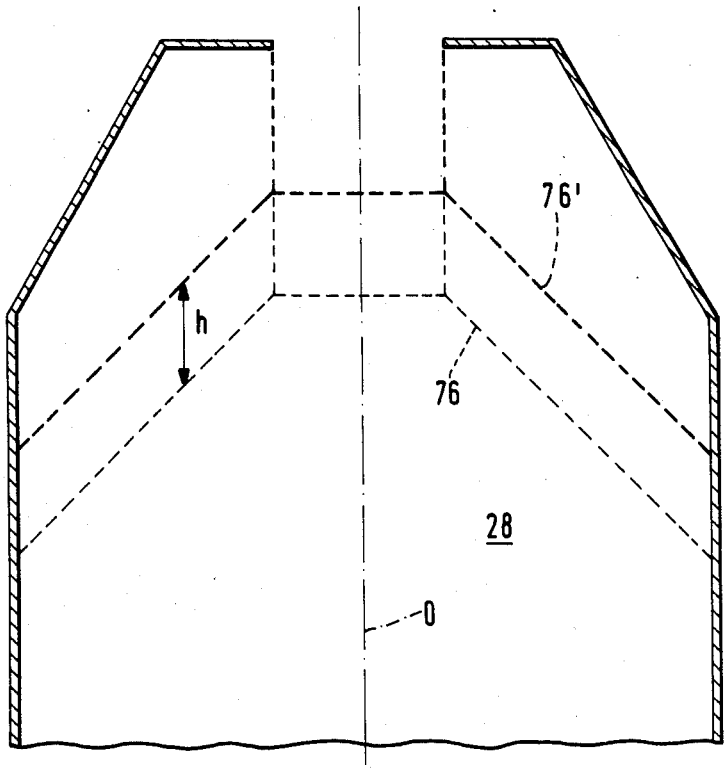
FIG. 8 is a diagrammatic view showing the gain in capacity the hopper of FIG. 6 can achieve with the closure device in accordance with the present invention.

A comparison of FIGS. 5 and 7, which are vertical sections containing in each case the curve of displacement of the center of valve 44 (e.g., the section planes a—a in FIGS. 5A and 7A), will show that in the open position, in FIG. 5, valve 44 occupies an almost vertical, deeper position, whereas in the embodiment shown in FIG. 7, its inclination is smaller and it is therefore higher. In view of the fact that in the embodiment shown in FIG. 7, the valve penetrates less deeply into lock chamber 28 when opened, the maximum charging level can be higher. This difference is clearly visible in FIG. 8, wherein the maximum charging level for the arrangement shown in FIG. 4 is represented by 76 and that of the embodiment shown in FIG. 6 (the present invention) is represented by 76'.

Figure 9:
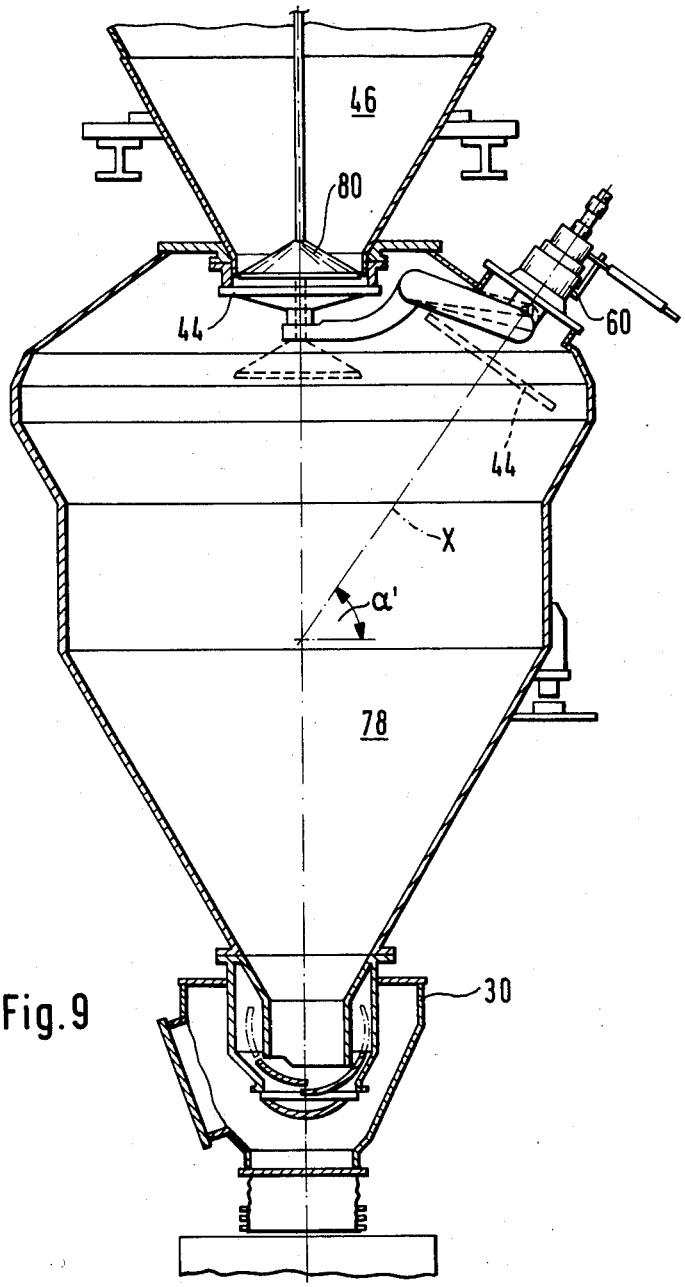
FIG. 9 is an elevation view, partly in cross section, showing a preferred form of construction of a storage hopper equipped with a closure device in accordance with the present invention.

The advantage which can be achieved by the inclination of the axis of rotation of valve 44 becomes more substantial the greater this inclination is made. FIG. 9 shows an advantageous embodiment applying the principles of the present invention, the same reference numerals being used as in the preceding Figures to designate two corresponding elements. In this embodiment, the axis of rotation X of valve 44 is greatly inclined relative to the horizontal, in other words the angle $\alpha'$ is substantially larger than the angle $\alpha'$ in FIG. 6. This greater inclination lowers still further the point of intersection of the axis X and the axis 0, thus greatly increasing the radius of the sphere of displacement of valve 44. It is for that reason that lock chamber 78 in the embodiment shown in FIG. 9 is generally pear shaped, with its largest section on the trajectory imparted to valve 44 by its inclined support 60.

The open position of valve 44 is shown in broken lines on the axis of rotation X in FIG. 9. It will be noted that in this embodiment, valve 44 occupies an even less inclined position than that shown in FIG. 7, thus further raising its bottom edge and permitting even better filling than in the case of the embodiment shown in FIG. 6.

Figure 11A:
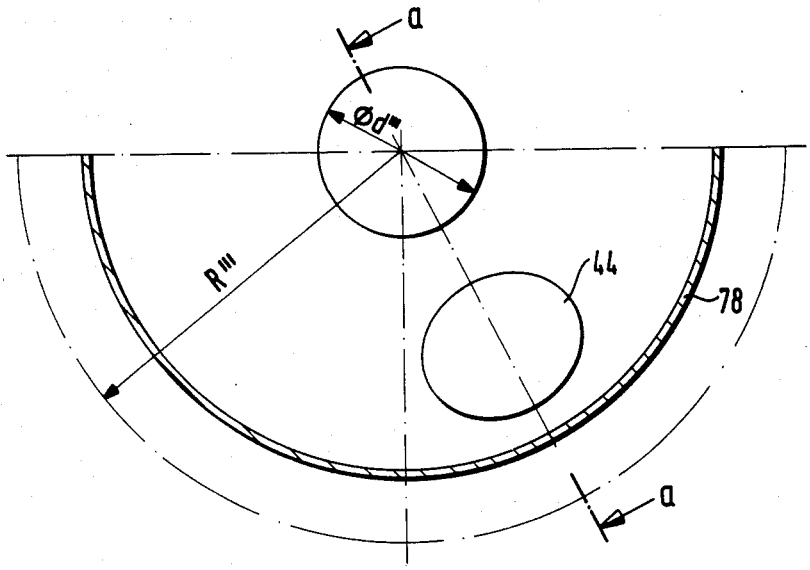
FIG. 11A is a diagrammatic horizontal view showing the open position of the valve of FIG. 9.

The end of the charging phase of lock chamber 78 is illustrated diagrammatically in FIGS. 10, 11 and 11A, which correspond respectively to the views shown in FIGS. 6, 7 and 7A. Taking into account the width of lock chamber 78 in the upper region, it is necessary to provide a device for distributing the charge material in order to be able to direct that material into the peripheral region of lock chamber 78. For that purpose, nonreturn valve 80 controlling the flow of the charge material from hopper 46 into lock chamber 78 is configured in the shape of a bell and is displaceable in the vertical direction in a manner known per se, by means which are not shown. In order to direct the charge material into the central region, bell 80 is lowered into the position shown in broken lines. At the end of the charging phase, bell 80 is progressively raised to move the fall trajectory of the charge material away from axis 0 and thus to direct it towards the peripheral region of lock chamber 78.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for closing the opening of a vessel, the vessel having a wall, the apparatus comprising:

sealing valve means adapted to seal the opening of the vessel;

a control arm having opposed first and second ends, a first end being operatively connected to said sealing valve means and adapted for placement in the vessel;

means for actuating said sealing valve means, said actuating means comprising;

rotary support means for rotating about a first axis;

bearing means housing said rotary support means in the vessel wall;

means for axially displacing said sealing valve means with respect to the vessel opening, said axially displacing means being connected to said second end of said control arm and said rotary support means; and said rotary support means being mounted on the vessel wall so that said first axis of rotation forms an acute angle with respect to a vertical axis of the vessel opening.

2. The apparatus of claim 1 including:

clevis means forming a pivotable support for said control arm;

a control rod axially disposed in said rotary support means, said second end of said control arm being connected to said control rod; and motor means, said motor means acting on said control rod to axially displace said control rod in said rotary support means.

3. The apparatus of claim 2 wherein:

said motor means is mounted on said rotary support means.

4. The apparatus of claim 1 wherein said vessel is a storage hopper for a shaft furnace and wherein, upon opening of said sealing valve means, said sealing valve means sweeps out a displacement trajectory within said storage hopper and wherein:

said storage hopper has a substantially pear shape which includes a large diameter section, said large diameter section being positioned at the level of the displacement trajectory of said sealing valve means.

* * * * *